US006601728B1

(12) United States Patent
Newkirk et al.

(10) Patent No.: US 6,601,728 B1
(45) Date of Patent: Aug. 5, 2003

(54) THERMAL CUP HOLDER

(76) Inventors: Raymond Newkirk, 1489 Shoreline Dr., Wayzata, MN (US) 55391; Stephen J. Flasch, P.O. Box 154, Forest Lake, MN (US) 55025

( * ) Notice: Subject to any disclaimer, the term of this patent is extended or adjusted under 35 U.S.C. 154(b) by 0 days.

(21) Appl. No.: 10/281,838

(22) Filed: Oct. 28, 2002

(51) Int. Cl.[7] ..... B65D 25/20
(52) U.S. Cl. ..... 220/739; 229/403; 220/740
(58) Field of Search ..... 220/740, 739, 220/738, 903, 375; 229/403

(56) References Cited

U.S. PATENT DOCUMENTS

| | | | | | |
|---|---|---|---|---|---|
| 2,563,352 | A | * | 8/1951 | Morse | 206/515 |
| 3,126,139 | A | * | 3/1964 | Schechter | 229/403 |
| 3,860,162 | A | | 1/1975 | Schutz | |
| 3,927,794 | A | | 12/1975 | Erdman | |
| 4,106,660 | A | | 8/1978 | Boyle | |
| 4,187,954 | A | | 2/1980 | Striggow | |
| 4,194,627 | A | | 3/1980 | Christensen | |
| 4,361,249 | A | | 11/1982 | Tuneski et al. | |
| 4,503,992 | A | | 3/1985 | Sitko et al. | |
| 4,589,569 | A | | 5/1986 | Clements | |
| D287,919 | S | | 1/1987 | Clements | |
| 5,205,473 | A | * | 4/1993 | Coffin, Sr. | 229/403 |
| 5,348,181 | A | | 9/1994 | Smith et al. | |
| D353,328 | S | | 12/1994 | Nuffer | |
| 5,425,497 | A | | 6/1995 | Sorensen | |
| 5,547,124 | A | | 8/1996 | Mueller | |
| D379,928 | S | | 6/1997 | Freek et al. | |
| 5,765,716 | A | | 6/1998 | Cai et al. | |
| D402,556 | S | | 12/1998 | Frye | |
| 5,960,984 | A | * | 10/1999 | Weston | 220/739 |
| D417,845 | S | | 12/1999 | Sadlier et al. | |
| 5,996,837 | A | | 12/1999 | Freek et al. | |
| 6,047,852 | A | | 4/2000 | Evans et al. | |
| 6,053,352 | A | * | 4/2000 | Cai | 220/739 |
| 6,152,363 | A | * | 11/2000 | Rule, Jr. | 229/403 |
| 6,374,726 | B1 | | 4/2002 | Melton | |

* cited by examiner

*Primary Examiner*—Joseph M. Moy
(74) *Attorney, Agent, or Firm*—Haugen Law Firm PLLP

(57) ABSTRACT

A cup-enveloping sleeve of elongated configuration for creating a thermal barrier around the circumference of a beverage cup or container. The sleeve comprises a flexible body with opposed top and bottom edges, with arcuately spaced apart arrays of radially projecting ribs being formed on the body and extending continuously between the top and bottom edges. At least one additional array of reticulated radially inwardly extending projections are provided, and positioned between mutually adjacent pairs of rib arrays, with these projections being segmented to define circumferentially extending land areas between mutually adjacent segments of projections so as to permit the sleeve to engage a variety of conventional cup sizes, and also to provide space for advertising or instructive indicia. Engageable couplings are provided to convert the elongated sleeve to a frusto-conical configuration.

8 Claims, 4 Drawing Sheets

THERMAL CUP HOLDER

BACKGROUND OF THE INVENTION

The present invention relates generally to an improved beverage cup holder and protector, and more particularly to such a cup protector comprising a thermally insulating or isolating cup-enveloping sleeve with a body of generally truncated cylindrical complimentary to and matching that of any one of a family of these beverage cups commonly employed in commercial and domestic use. Because beverages such as coffee are normally served hot, there is a need for a thermal isolation barrier to be interposed between the cup surface and the hand of the user, since hot beverages are typically vended with the expectation that prior to consumption there will be a time lapse to permit the beverage to cool until reaching a desired drinking temperature.

Coffee and other hot beverages are frequently sold through vending stations or machines or in "coffee houses" where they are served over the counter both of which are on a self-serve basis. The purchaser or user hand carries the cup to a location where it may be conveniently consumed. In the past, hot beverages were frequently served in foam resin containers, with the foam resin providing a thermal barrier for the user. Recently, however, it has been concluded that cups prepared from paper or solid molded plastic are more environmentally friendly, and hence fulfill an environmental need and provide some added appeal to the consuming public. Thus, protective sleeves are desired for providing thermal isolation between the outside surface of the cup and the hands of the consumer.

Vending stations or machine locations and coffee houses typically offer a size selection for hot beverages, such as, for example, small, medium, and large. Commercial establishments have generally settled on a family of sizes for cup containers, with the family typically having a common diameter across the open top, and with the length or height of the cup determining its capacity. Since the outer diameter of the cup is generally determined by a convenient hand-holding size for the public, only the cone angle of individual cups within each family of cups will vary, with the longer, larger capacity cups having a cone angle less than that of the shorter or smaller cups. Thus, it is desirable for cup-enveloping sleeves to be versatile, and capable of accommodating cups within the range of sizes offered with the family of sizes.

SUMMARY OF THE INVENTION

In accordance with the present invention, a beverage cup protector is provided which comprises a cup-enveloping sleeve with a hand-gripping cup-engaging body portion of generally truncated cylindrical configuration with open top and bottom ends. The sleeve comprises a flexible plastic body with opposed top and bottom edges defining the openings, and with a plurality of arcuately spaced arrays of flexible elongated expansible ribs extending continuously between said top and bottom edges. These ribs are of a height sufficient to isolate and thermally insulate the surface of the outer hand-gripping portion of the sleeve from the surface of the serving cup. The configurational design of the improved beverage cup holder and protector enables production of a combined sleeve and cap-lid with production being achieved from use of the same material and pursuant to same production methods. Between each mutually adjacent array of elongated ribs, there is positioned a reticulated radial inwardly extending projections, with the reticulated projections being segmented and defining circumferentially extending land areas between mutually adjacent segments of projections. These land areas are provided in order to increase the surface area available for hand gripping, and also to permit printing of advertising indicia or the like on the exposed surface. There may also be provided an integrally hinged cup lid for grippingly engaging the top rolled edge of the beverage cup, with flexible link means being provided for coupling the lid to the cup-engaging sleeve.

In the design of the cup-enveloping sleeve of the present invention, the flexible elongated ribs permit extension or elongation of the sleeve length, with the configuration of the inter-rib spacing or gap between the ribs being altered from a normal generally rectangular configuration to an inwardly/downwardly tapered configuration to permit the sleeve to conform to the frusto-conical configurations of each of a family of beverage cups. The expansible ribs are preferably tapered inwardly from the top edge to the bottom edge so as to provide an elongated rib with a vertical axis parallel to the elongated axis of the beverage cup. This design provides an added element of symmetry, and also enables the cup-enveloping sleeve to conform to each cup within the family of cups.

In order to permit the cup-engaging sleeves of the present invention to be shipped and stored in flat nested form, each of the flanged projections is tapered at an angle so as to accommodate stacking of a large number of sleeves in a nested arrangement. Also, complimentary male and female snap fit projection means are formed within the body adjacent the sides, with one or more sets of said snap means being provided for inter-engagement to snapably engage and retain said sides together in superposed relationship.

Therefore, it is a primary object of the present invention to provide an improved beverage cup protector in the form of a cup-enveloping sleeve which provides thermal isolation for the user, and wherein the cup-enveloping sleeve is adapted for use with any of a family of paper cups commonly employed by commercial vending establishments as well as domestic use.

It is a further object of the present invention to provide an improved beverage cup protector in the form of a cup-enveloping sleeve with a body of truncated cylindrical configuration with opposed open top and bottom ends, and wherein the sleeve comprises a plurality of arcuately spaced apart arrays of expansible ribs to permit use on a variety of sizes of beverage cups.

It is a further object of the present invention to provide an improved insulating sleeve and lid or cap configured to permit simultaneous manufacture from the same material and pursuant to the same manufacturing and/or production methods.

It is yet a further object of the present invention to provide improved cup-enveloping sleeves to create a beverage cup protector with the sleeve including a beverage cup lid for grippingly engaging the top edge of the cup, and with flexible link means coupling the lid to the cup-engaging sleeve.

It is still a further object of the present invention to provide an improved cup-enveloping sleeve for beverage cup protection in which the sleeves may be shipped and stored in a nested flat arrangement, and with opposed sides being snapped together to create the conical enclosure for engaging the cup periphery as required.

Other and further objects of the present invention will become apparent to those skilled in the art upon a study of the following specification, appended claims, and accompanying drawings.

IN THE DRAWINGS

DESCRIPTION OF THE PREFERRED EMBODIMENT

Figure 1:
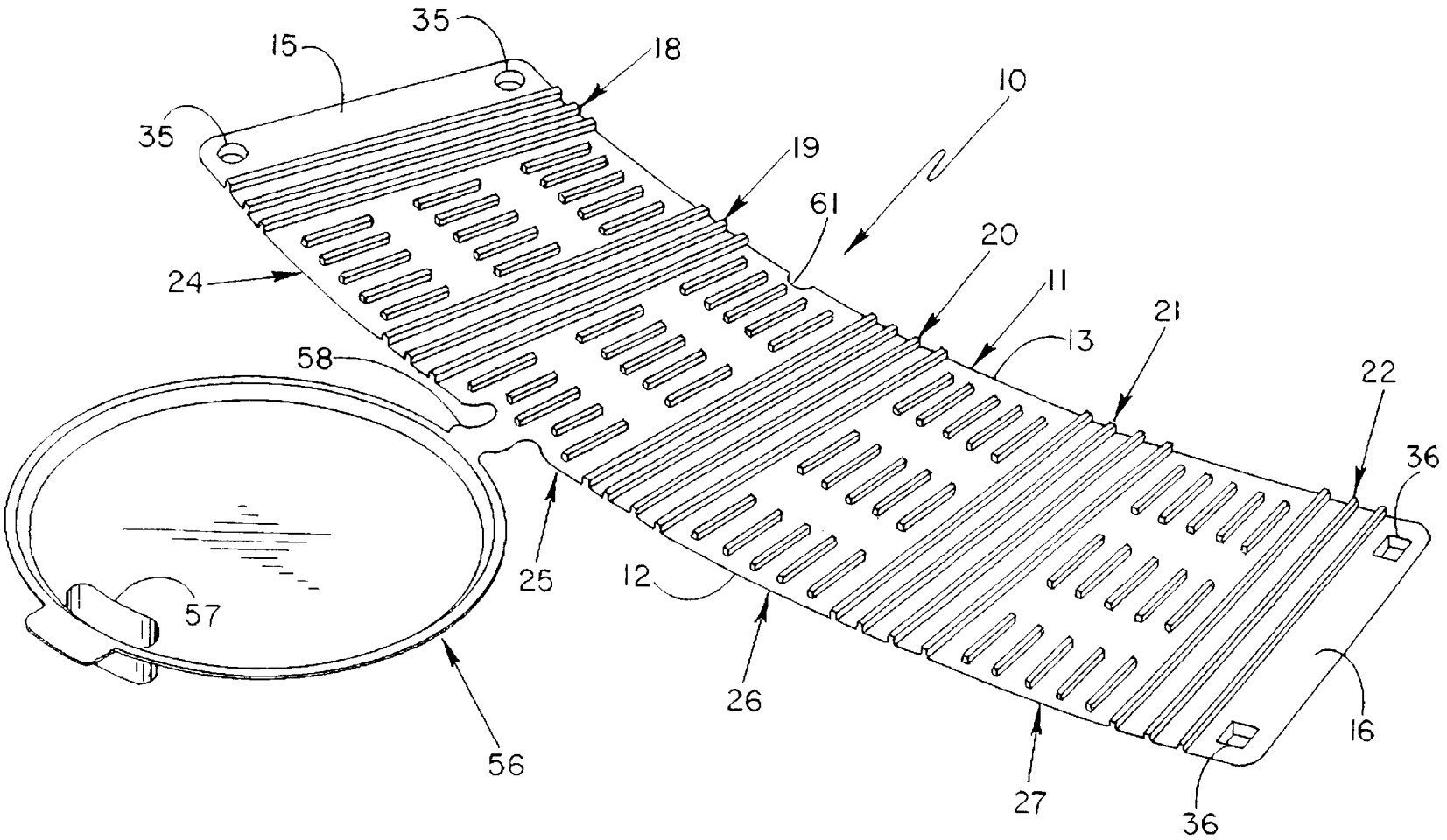
FIG. 1 is a perspective of the cup-enveloping sleeve of the present invention, with the view illustrating the elongated body of the sleeve together with a lid that is coupled to the sleeve body through hinged link means.
Figure 2:
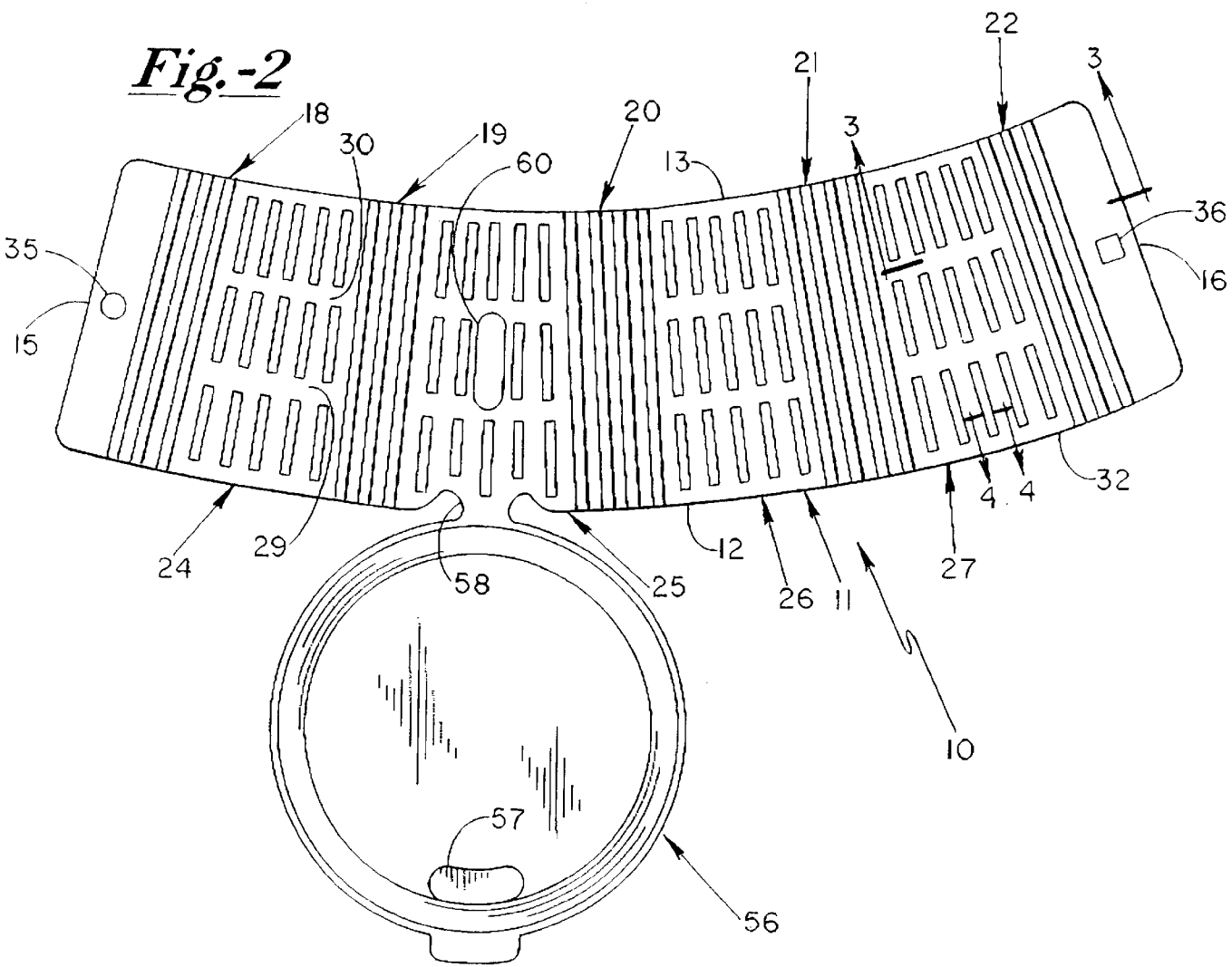
FIG. 2 is a top plan view of a slightly modified embodiment of the cup-enveloping sleeve illustrated in FIG. 1.

In accordance with the preferred embodiment of the present invention and with particular attention being directed to FIGS. 1 and 2 of the drawings, the cup protector generally designated 10 comprises an elongated hand-gripping cup-engaging body 11, the lateral ends of which may be joined to create a truncated cylindrical configuration and with opposed top and bottom edges as at 12 and 13 respectively. Thus, a cup-engaging body 11 is formed when opposed sides 15 and 16 are held in mutual engagement and the hand-gripping cup-engaging body of truncated cylindrical configuration is created. A plurality of arcuately spaced apart arrays of radially projecting ribs are shown at 18, 19, 20, 21, and 22, with these ribs being formed in the cup-engaging body 11 and extending continuously between top and bottom edges 12 and 13 respectively. An array of reticulated radially inwardly extending projections is positioned between each mutually adjacent pair of said rib arrays, with said reticulated projections being shown at 24, 25, 26, and 27. The rib arrays are provided in order to perform two valuable functions, one being the thermal insulation function, the other being that of adjustably and resiliently accommodating various sizes of cups within a family of cups of differing volumes. The radially inwardly extending projections are segmented with aligned axes to define circumferentially extending land areas 29 and 30. These land areas extend between mutually adjacent segments of each elongated projection, with one circumferentially extending land area being positioned adjacent each of said top and bottom edges 12 and 13, with these edge-oriented land areas being shown at 32 and 33.

The design of the elongated ribs, as shown in FIGS. 1 and 2, is such that the spacing between each pair of ribs is tapered modestly inwardly from top edge to bottom edge so as to preserve integrity and continuity, and also to accommodate uniform flexure when dealing with cups of somewhat differing dimensions. In other words, this spacing configuration permits a single holder to appropriately accommodate a variety of cup sizes. The ribs in each of the members in families 18 through 22 inclusive are arranged to extend continuously so as to span the entire area between top and bottom edges 12 and 13 respectively.

Figure 3:
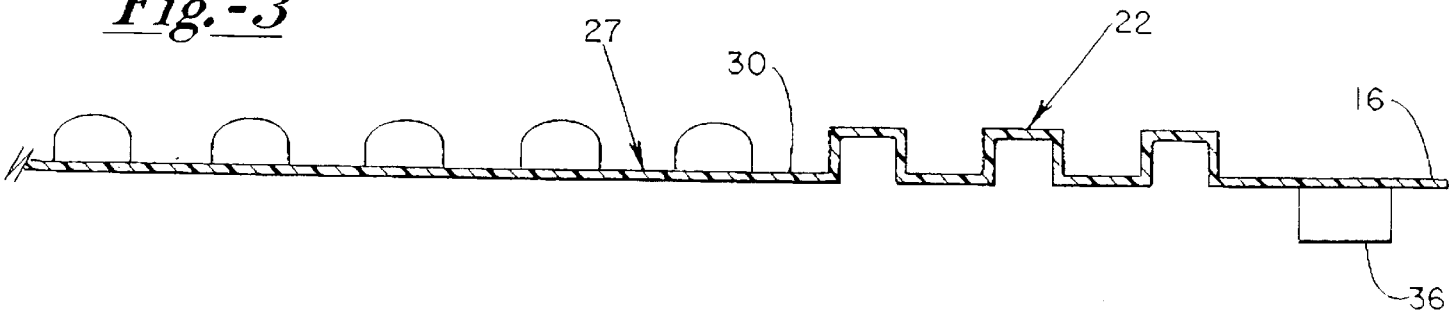
FIG. 3 is a vertical sectional view on a slightly enlarged scale, and taken along the line and in the direction of the arrows 3—3 of FIG. 2.

With continued attention being directed to FIGS. 1 and 2, it will be observed that mating or matching sets of complimentary male and female snap means are formed within the body as at 35—35 and 36–36. These snap projections are molded and/or formed within the body of the cup-engaging sleeve, adjacent sides 15 and 16, and are designed for inter-engagement to snapably retain the sides together in end-to-end relationship for use. As indicated in FIGS. 1–3, these snap fit means and/or projections are respectively formed with a round outer surface and square outer surface for accommodating reliable inter-engagement. It will be observed that in FIG. 1, two mating sets of male and female snap means are utilized, with the alternative embodiment of FIG. 2 illustrating a single such set. Other coupling means suited for the application may be found to be useful.

As indicated hereinabove, the alternative embodiment of FIG. 2 responds in most part to the structure illustrated in FIG. 1. In the embodiment of FIGS. 1 and 2, a lid member generally designated 56 and having a drinking or pouring spout 57 integrally therewith is hingedly secured to cup-engaging body 11 by hinge 58. Aperture 60 is provided in body 11 in order to permit the user to orient spout 57 at a point where it will be out-of-alignment with any overlapping seam of the type commonly used in cups fabricated from paper. Such careful orientation will minimize any risk of leakage of the contents from the juncture of lid 56 and the cup seam.

As indicated in FIG. 1, an inwardly extending sight-notch 61 is provided in order to facilitate ease of alignment of the spout 57 with an appropriate location or orientation on the cup wall. In this connection, sight-notch 61 is placed in alignment with the cup seam in order to reduce and/or eliminate leakage that may otherwise occur at or about the seam, thereby confining and/or restraining any such leakage to the spout zone. Also, as indicated in the embodiments of both FIGS. 1 and 2, a finger-gripping lifting/closure tab is provided on the lid immediately radially outwardly adjacent spout 57.

Figure 5:
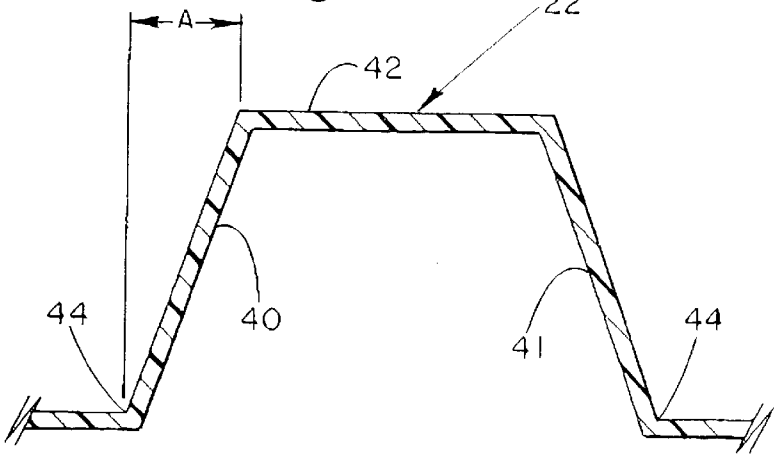
FIG. 5 is a view similar to FIG. 4 and illustrating the elongated rib of FIG. 4 in its stretched or extended disposition.
Figure 4:
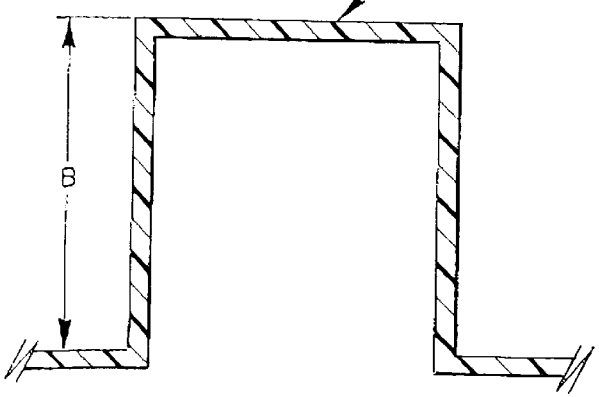
FIG. 4 is a sectional view of the elongated rib in its normal disposition and on an even larger scale taken along the line and in the direction of the arrows 4—4 of FIG. 2.
Figure 6:
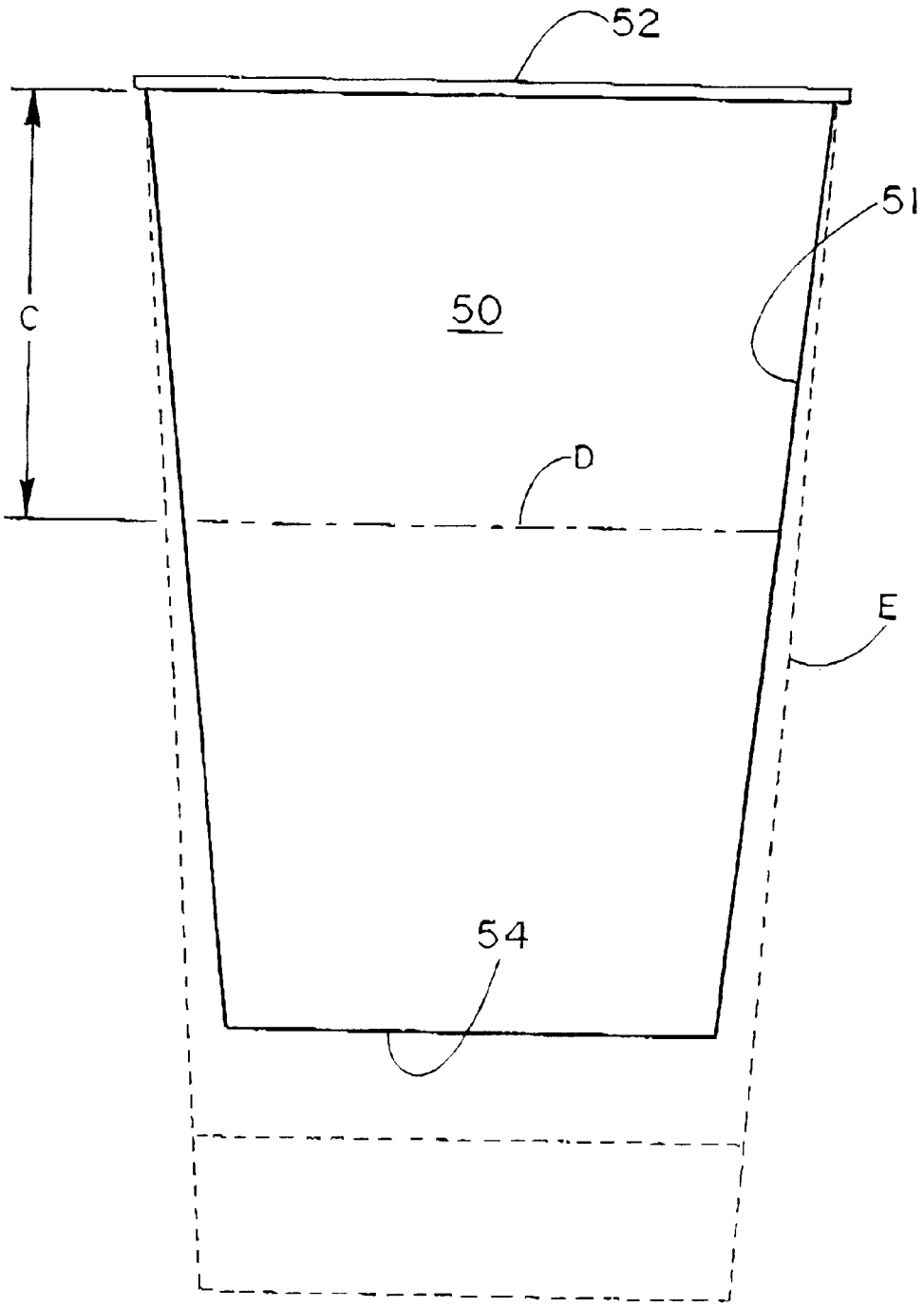
FIG. 6 is a side elevational view of a typical beverage cup for use with the cup-enveloping sleeve of the present invention, and illustrating, in phantom, the axial length of a family of such cups of varying capacities.

With attention now being directed to FIGS. 3, 4 and 5 of the drawings, it will be noted that elongated rib 18 has a generally rectangular cross-sectional configuration. As formed, and in its normal disposition, rib 18 assumes the configuration illustrated in FIG. 4. When an expansive force is exerted on rib 18, the configuration changes to that of a rib with outwardly converging walls such as at 40 and 41. Outer cap surface as illustrated at 42 is accordingly hinged relative to walls 40 and 41 as at 43—43 as well as at 44—44. In one typical embodiment, the dimension "A" is necessarily equal to approximately 0.006 for the reasons set forth below. For most materials of constructions, the dimension "A" is necessarily accompanied by a rib projection having a radial height as represented by "B" in FIG. 4. In order to accommodate a typical size cup of the configuration and size illustrated in FIG. 6, the following demonstrative calculations are provided. Cup generally designated 50 includes an open top container as at 51 with a rolled rim 52 defining the open top. A closed bottom is illustrated at 54. Dimension "C" represents the overall height of a typical cup-enveloping sleeve in accordance with the present invention, with this sleeve being required to comfortably and reliably mate with cups having dimensions represented by diameters "D" while at the same time accommodating cups having a diameter "EE" at the bottom of the cup-enveloping sleeve 10. In the most commonly used commercial and domestic families of cups, the difference between dimension "D" and "E" is 0.2 inches. By arranging a total of seventeen elongated ribs, such as those shown at 18–22 inclusive, a total adjustment tolerance of 0.204 inches is achieved. Typical dimensional arrangements are as follows:

| Dimensional Element | Inches |
|---|---|
| A | 0.006 |
| B | 0.095 |
| C | 2.0 |
| D | 2.882 |
| E | 3.058 |
| Wall thickness (hips) | 0.015 inches. |

While a variety of materials of construction may be employed for fabrication of the cup-enveloping sleeves of the present invention, it has been learned that high impact polystyrene or "hips" is ideally suited. This material, which is acceptable to the U.S. Food and Drug Administration for food use has the physical properties well suited for this application. Furthermore, it is widely available on a sound economic basis. Dimensional selections may vary depending on material type, grade, and thickness. In those certain applications of the present invention wherein the hinged cover portion is not employed, certain other materials such as, for example, a fiber material comprising pleated cardboard could be utilized.

It will be appreciated that various modifications may be made to the present invention without departing from the spirit and scope of the invention.

What is claimed is:

1. A thermal cup protector comprising a cup enveloping sleeve with an elongated hand-gripping cup-engaging body of truncated cylindrical configuration and with opposed open top and bottom ends, said cup-engaging sleeve comprising:

(a) a flexible body with opposed top and bottom edges;

(b) a plurality of arcuately spaced apart arrays of radially projecting ribs are formed in said cup-engaging body and extend continuously between said top and bottom edges; and (c) an array of reticulated radially inwardly extending projections positioned between each mutually adjacent pair of said rib arrays with said reticulated projections being segmented to define circumferentially extending land areas between mutually adjacent segments of each elongated projection with one circumferentially extending land area being positioned adjacent each of said top and bottom edges and extending continuously between each mutually adjacent array pair of said elongated ribs.

2. The cup-engaging sleeve of claim 1 wherein gaps between mutually adjacent elongated ribs converge downwardly between said top and bottom edges, and wherein said ribs are expandable between a normal generally rectangular cross-sectional configuration and a stretched extended outwardly converging configuration to permit said cup-engaging sleeve to conform to the frusto-conical configuration of each of a family of beverage cups.

3. The cup-engaging sleeve of claim 2 wherein said cup-enveloping sleeve is compatible with a family of dimensionally different frusto-conical drinking cups, with each having a common top dimension and with varying height dimensions to accommodate different capacities within said family.

4. The cup-engaging sleeve of claim 1 wherein said complimentary male and female snap fit coupling means include a female member with a round outer surface and a male prong member of square configuration.

5. The cup-engaging sleeve of claim 1 wherein said cup-enveloping sleeve is fabricated from high impact polystyrene.

6. The cup-engaging sleeve of claim 1 wherein said cup-enveloping sleeve comprises a lid for grippingly engaging the top edge of the cup being enveloped by said sleeve, and with flexible link means coupling said lid to said cup-enveloping sleeve.

7. The cup-engaging sleeve of claim 6 wherein a site aperture is formed in said cup-engaging body, with said aperture being generally in alignment with said flexible link means.

8. A thermal cup protector comprising a cup enveloping sleeve with an elongated hand-gripping cup-engaging body of truncated cylindrical configuration and with opposed open top and bottom ends, said cup-engaging sleeve comprising:

(a) a flexible body with opposed top and bottom edges;

(b) a plurality of arcuately spaced apart arrays of radially projecting ribs are formed in said cup-engaging body and extend continuously between said top and bottom edges; and (c) each of said spaced apart arrays of radially projecting ribs comprising a discrete grouping of radially projecting ribs, and wherein multiple arrays are formed in said cup-engaging body with each of said arrays being spaced from its neighbor by land areas.

* * * * *